US005190202A

United States Patent [19]

Mischker et al.

[11] Patent Number: 5,190,202

[45] Date of Patent: Mar. 2, 1993

[54] APPARATUS AND METHOD FOR DRAWING YARN FROM A CONVEYOR

[75] Inventors: Rolf Mischker; Eugen Hommel, both of Charlotte, N.C.

[73] Assignee: American Suessen Corporation, Charlotte, N.C.

[21] Appl. No.: 616,929

[22] Filed: Nov. 21, 1990

[30] Foreign Application Priority Data

Dec. 1, 1989 [DE] Fed. Rep. of Germany ..... 3939823

[51] Int. Cl.[5] ..... B65H 51/20

[52] U.S. Cl. ..... 226/118; 226/4; 226/29; 226/45; 226/171

[58] Field of Search ..... 226/118, 26, 24, 27, 226/28, 29, 45, 2, 4, 170, 171; 242/45

[56] References Cited

U.S. PATENT DOCUMENTS

| | | | |
|---|---|---|---|
| 3,115,999 | 12/1963 | Wythe | 226/45 X |
| 3,182,536 | 5/1965 | Sumpter, Jr. et al. | 226/45 X |
| 3,300,830 | 1/1967 | Johnson | 242/45 X |
| 3,749,327 | .7/1973 | Roethke et al. | 242/45 X |
| 3,891,155 | 6/1975 | Naegeli | 242/45 |
| 4,019,691 | 4/1977 | Wroclawski et al. | 242/45 |
| 4,365,395 | 12/1982 | Brantley | 226/118 X |
| 4,369,905 | 1/1983 | Tokuno | 226/45 X |
| 4,373,362 | 2/1983 | Fleissner | 226/45 X |
| 4,432,501 | 2/1984 | Arendt et al. | 226/118 X |
| 4,481,066 | 11/1984 | Hirakawa et al. | 226/170 X |
| 4,591,084 | 5/1986 | Balian et al. | 226/118 |
| 4,610,379 | 9/1986 | Voisin | 226/118 X |
| 5,012,657 | 5/1991 | Serracant-Clermont et al. | 226/118X |

FOREIGN PATENT DOCUMENTS

| | | |
|---|---|---|
| 2747368 | 5/1978 | Fed. Rep. of Germany . |
| 88/06653 | 7/1988 | Fed. Rep. of Germany . |
| 90/00937 | 2/1990 | Fed. Rep. of Germany . |
| 2621569 | 10/1988 | France . |

*Primary Examiner*—Daniel P. Stodola
*Assistant Examiner*—P. Bowen
*Attorney, Agent, or Firm*—Burns, Doane, Swecker & Mathis

[57] ABSTRACT

Yarns are deposited on a conveyor belt in the form of random or ordered loops and are conducted through a yarn treating chamber. The treated yarn is drawn from the belt at a predetermined draw-off site. The position of the last yarn loop adjacent the draw-off site is scanned by a sensor, and the draw-off velocity is controlled as a function of deviations in the location of this last yarn loop. At the draw-off site a holding device is provided to press the looped yarn against the conveyor belt. During any interruptions of the drawing-off operation, the yarn will accumulate on the conveyor belt. The holding device and sensor are mounted to a slide which relocates the sensor and holding device downstream to a position in the vicinity of the last yarn loop so that the holding device will act on the yarn when the drawing-off operation is resumed. The holding device is then moved upstream along with the last yarn loop as the drawing-off operation proceeds.

17 Claims, 2 Drawing Sheets

A
B
C
D
E
X
1
2
3
4
5
6
7
8
9
10
11
12
13
14
15
16
17
18
19
20
21
22
23
24
25
26
27
28
29
30
31
32
33
34
35
36
41

APPARATUS AND METHOD FOR DRAWING YARN FROM A CONVEYOR

BACKGROUND OF THE INVENTION

The invention concerns an apparatus and method for drawing looped yarn from a conveyor belt.

It is known from German Patent 27 47 368 to pass a conveyor belt through a yarn treating chamber upon which the yarn is located in the form of a hollow cylinder of ordered loops. After the looped yarn has been treated in the chamber the loops are unravelled, and the yarn is drawn from the conveyor belt and wound onto a spool. The rate of yarn removal is a function of the rate at which the looped yarn is deposited onto the conveyor belt and of the shrinkage of the yarn during the heat treatment. A photoelectric cell is located at the outlet of the yarn treating chamber to detect the position of the terminal loops prior to their removal from the conveyor belt and regulate the rate at which the yarn is drawn off the belt in accordance with that detected position.

It is further known in such an apparatus to provide a holding device to keep the loops pressed flat on the conveyor belt prior to their removal. This device is in the form of a stationary trough, which defines the draw-off point of the yarn from the conveyor belt. The yarn is drawn off at said draw-off point initially essentially parallel to the conveyor belt.

If the operation of the drawing-off device, which for example may be a spooling frame, is interrupted, for example when the spooling frame must be temporarily deactivated to replace a receiving spool, more loops than normal accumulate on the conveyor belt and move downstream of the holding device. The photoelectric cell correlated with the draw-off point is ineffective in such a case, as it is no longer able to detect the end of the loops. The holding device no longer cooperates with the last loop. This can lead to difficulties upon the reactivation of the draw-off mechanism, as the loops located on the conveyor belt may be opened up (drawn off) without being held flat against the conveyor belt. This could interfere with the draw-off process.

It is an object of the invention to provide an apparatus and method of the aforementioned type so that the yarn is removed from the conveyor belt without difficulty even if the operation of the drawing device is interrupted.

SUMMARY OF THE INVENTION

This is achieved by providing a displacing mechanism which displaces the holding device downstream with the conveyor belt when the drawing-off operation ceases. Thus, when the drawing-off operation recommences, the holding device will be situated in the vicinity of the terminal loop to perform its holding function on the looped yarn.

By virtue of this arrangement, the holding device is always coordinated with the draw-off point, so that an orderly opening of the loops and adequate removal of the yarn are possible even if the sensor is no longer able to control the draw-off device. Following the resumption of the operation of the draw-off device, the holding device defining the draw-off point returns to the original upstream operating position over the conveyor belt at the rate at which the loops are retracted, i.e., at a temporarily increased draw-off rate.

Advantageously, the holding device is located on a slide which also carries the sensor for the scanning of the operational position of the last loops. This arrangement makes it possible for the sensor to influence the rate of yarn draw-off during the return travel of the holding device.

In an advantageous embodiment the sensor, during the operation of the draw-off device, controls a motor driving the draw-off device. With the draw-off device deactivated and/or upon the return of the slide into the operating position, the sensor also controls the drive of the slide. If, for example a sensor in the form of a light barrier coordinated with the sensor is darkened longer than a predetermined period of time, it indicates to the control apparatus associated with the sensor that the draw-off device is not operational. Instead of the drive motor of the draw-off device being actuated, the drive moving the slide is actuated by the control apparatus. The slide carrying the holding device may then be located on a guide rail and connected with a chain drive actuated by a control motor.

Alternatively, it is possible to attach the holding device directly to the conveyor to move with it if the draw-off device is inactive. In such a case the control apparatus does not regulate the drive of the slide, but rather regulates a coupling element whereby the holding device may be connected with the conveyor belt. However, for the return of the holding device into the operating position, actuation by means of the drive of the above-described slide is required, as the direction of motion of the slide is opposite to that of the conveyor belt. During the return movement, therefore, both the control motor of the slide and the drive motor of the reactivated draw-off device are simultaneously actuated. The original operating position of the holding device may be established by means of a control cam actuating a switch, whereby the slide is arrested in its operating position.

As mentioned above, the draw-off device operates, upon the resumption of its activity, at a relatively high draw-off velocity until the holding device has reached its original operating position. The holding device moves back into its operating position at a velocity such that it is always located approximately within the vicinity of the last loops. The return velocity of the holding device, relative to the instantaneous draw-off velocity, is slightly lower, so that the velocity of the draw-off device may be briefly reduced if necessary, in case the sensor determines that the location of the holding device no longer corresponds to the exact instantaneous location of the last loops.

In a preferred embodiment of the invention the holding device comprises a hold-down member which presses the last loops against the conveyor belt. The hold-down member is preferably in the shape of a convex trough facing the conveyor belt and defines by means of its curvature the direction of the drawing off of the yarn. Alternatively, the holding device may comprise a suction box or the like, placed beneath the conveyor which is permeable. Suction from the suction box holds the yarn against the conveyor. This embodiment has the advantage that the exact position of the draw-off point of the yarn from the conveyor belt is not quite so sensitive and that greater tolerances are possible. Such tolerances appear in particular if the conveyor chain moving the slide does not run in an exactly synchronous manner with the conveyor belt. The suction box has the further advantage that the suction air constitutes cooling air which is circulated through the last loops, whereby the yarn is cooled following its exit from the yarn treating chamber and prior to spooling.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figures 1, 2:
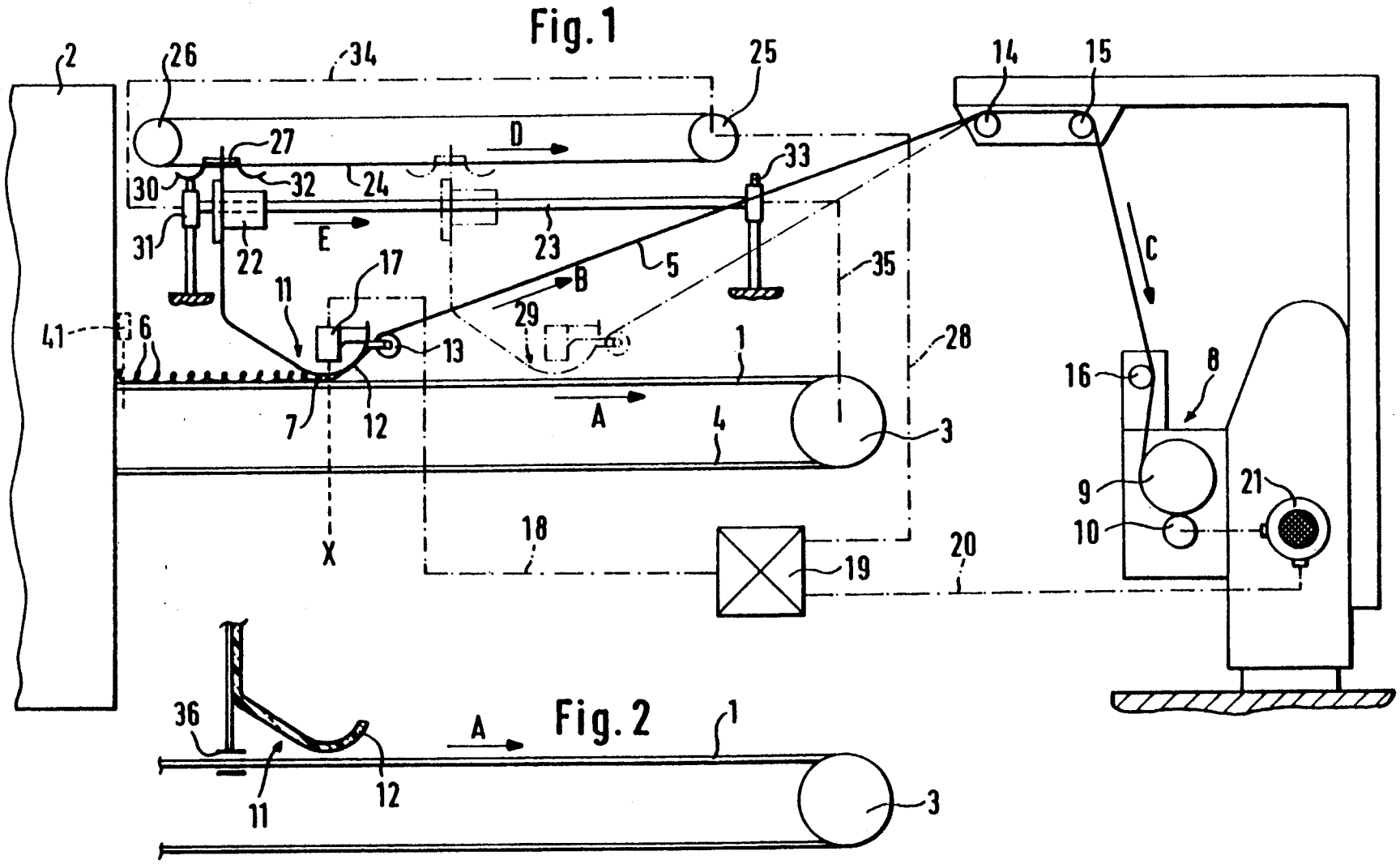
FIG. 1 shows a schematic lateral elevation of an apparatus according to the invention, located in the area of a yarn draw-off installation at the end of a conveyor belt which has passed through a yarn treating chamber, with a device carried on a slide to maintain the yarn loops flat.
FIG. 2 is an enlarged side view of the conveyor belt depicting a modification wherein the device to hold the last loops flat may be attached to the conveyor belt.

In FIG. 1, a conveyor belt (1), preferably a permeable mesh belt, such as a perforated textile belt, is depicted as it exits a yarn treating chamber (2) in the direction of the arrow (A). The belt is then reversed in direction downstream of a yarn treating chamber (2) around a driven roll (3), so that a return flight (4) passes back through the treating chamber (2). Upstream of the yarn treating chamber (2) the yarn (5) to be treated was placed onto the conveyor belt in the form of random or ordered loops 6 in a known manner by a conventional mechanism. This may be effected in the form of individual yarns, or several yarns (5) may be combined into common loops (6) and separated into individual yarns downstream of the heat treatment after or as the yarns (5) are drawn off the conveyor belt.

Downstream of the yarn treating chamber (2) the loops (7) are separated at a predetermined location (X) hereinafter designated as the operating position. The yarn (5) is then drawn off in the direction of the arrow (B) away from the conveyor belt. A yarn draw-off installation (8) comprises a spooling frame, in which the individual receiving spools (9) are wound by means of a driven roll (10), the yarn traveling in the direction of the arrow (C).

The operating position (X) for the resolution of the loops and the draw-off of the yarn (5) is extremely critical. The location of that position may vary as a function of the ratio of the drawing velocity of the draw-off installation (8) to the rate of the deposition of the loops on the conveyor belt and of the shrinking of the yarn.

In order to be able to better define the operating position, there is provided a holding apparatus (11) for holding the yarn loops against the conveyor belt (1) prior to a drawing-off of the loops. That holding apparatus (11) comprises a convex trough (12) preferably formed of a transparent plastic, extending laterally over the working width of the conveyor belt (1), a convex face of the trough arranged to face the conveyor belt (1) and flatten the yarn loops against the belt (1). The curvature of the trough (12) determines the direction of the drawing off of the yarn (5). In the area immediately downstream of the trough (12) the drawn-off yarn is initially passed over a reversing roll (13) and is then passed to the receiving spool (9) over additional reversing rolls (14, 15 and 16) mounted on the spooling machine.

The rate of withdrawal of the yarn from the conveyor belt (1) would be constant only if the drives of the conveyor belt (1), the draw-off apparatus (8) and the aforementioned loop deposition apparatus (not shown) would run exactly and constantly in a synchronous manner, and if the shrinking properties of the yarn in the treating chamber would not vary. However, those conditions will vary in actual practice. For this reason, at least one sensor (17) is provided to scan the position of the last loops (7). This may be effected, for example, by means of a light barrier, which is darkened or not by the last loops. The sensor (17) is connected by a line (18) with the control device (19), which in turn is coupled by a line (20) with the drive motor (21) of the winding roll (10).

If the last loops (7) terminate in the direction of transport (A) upstream of the operating position (X), the control device (19) receives from the sensor (17) a signal to reduce the velocity of the drive motor (21) of the draw-off device (8). If, on the other hand, the last loops (7) have passed the operating position (X), then the drive motor (21) is running too slowly and the control unit (19) causes the velocity of the draw-off apparatus (8) to be increased. In this manner, the draw-off point of the yarn (5) is always maintained in the area of the operating position (X).

The tolerance range, i.e., the range within which the position of the last loops (7) deviates from the operating position (X) should be as small as possible. In actual operation, this tolerance range is readily maintained by means of the sensor (17). However, in the case of an interruption of the operation of the draw-off apparatus (8), for example if a full receiving spool (9) must be replaced by an empty one, the control device (19) is no longer able to regulate the drive motor (21), which is now inactive. In this case, the last loops (7) would travel downstream far beyond the operating position (X), as the conveyor belt (1) is being driven in the direction of the arrow (A). In particular, the draw-off point would leave the area of the trough (12).

For this reason, in accordance with the present invention, the holding apparatus (11) is arranged so that even if the draw-off device (8) is inactive, the apparatus (11) remains within the vicinity of the draw-off point of the yarn (5). To achieve this, the trough (12) has an extension mounted on an overhead slide (22) which in turn is slidably mounted on a rail (23) for movement in, or opposite, a direction (E) parallel to the conveyor belt (1). This adjustability of the slide (22) is made possible by a conveyor chain (24), a lower flight of which may be driven in a direction (D) or opposite that direction. The conveyor chain (24) is driven by a control motor (25) containing a reversing roll and is reversed around a second roll (26). The trough (12) is fastened by means of a coupling element (27) to the conveyor chain (24), so that if the control motor (25) is actuated, the holding apparatus (11) will be displaced with the conveyor chain (24) in, or opposite, the direction (E).

As mentioned above, in normal operation the control device (19), which receives its signals from the sensor (17), regulates the drive motor (21) of the draw-off device (8). If the draw-off device (8) is inactive and the last loops (7) travel downstream beyond the operating position (X) during a period of time long enough for the sensor (17) to determine that this state is not being corrected (for example, for several tenths of a second), this is an indication to the control device (19) that the drive motor (21) is no longer being controlled. The control device (19) then switches over and controls the control motor (25) of the conveyor chain (24) via a line (28). This causes the slide (22) and the apparatus (11) to slide on the guide rail (23) in the direction (E). Hence, the trough (12), defining the draw-off point of the yarn (5), moves along with the varying position of the last loops (6), as indicated by a dash-and-dot line (29). Therefore, the draw-off point of the yarn defined by the trough (12) remains within the area of the terminal end of the loops even if the draw-off apparatus (8) is inactive and the rest of the conveyor belt remains active. Consequently, the removal of the yarn (5) takes place in an orderly manner upon reactivation of the drawing-off apparatus. When the draw-off apparatus (8) resumes its operation, the drive motor (21) may again be actuated by the control device (19) via the line (20), and the control motor (25) is reversed in its direction of rotation, so that the conveyor chain (24) moves opposite the direction (D), and the slide (22) moves opposite the direction (E). The trough (12) then slowly returns into the operating position (X).

This return of the trough (12) to the operating position (X) should keep pace with the removal of the last loops (7). The amount of the accumulated yarn on the conveyor belt (1) between the operating position (X) and the driven reversing roll (3) is reduced by a temporarily increased draw-off velocity of the draw-off apparatus (8). This velocity may, for example, be higher by 10% than the normal value. The velocity at which the trough (12) returns to the operating position (X) should be adapted continuously to the instantaneous position of the last loops (7). However, the velocity of the slide (22) is set about 3% lower than the theoretically required return velocity, in order to make it possible for the sensor (17), which now is again operational, to slightly increase or reduce the velocity of the drive motor (21), even during the return motion, as a function of the deviation of the position of the last loops (7) from the instantaneous position of the trough (12). The draw-off apparatus (8) is therefore controlled during the return of the slide (22) into the operating position (X) in the same manner as when the operating position (X) is attained.

The slide (22) is connected with a control cam (32), which actuates another terminal switch (33) at the end of movement in the direction (E), if there is a danger that no more space is available on the conveyor belt (1) to accumulate yarn. This may occur, for example, when the draw-off apparatus has been inactive for a period of time longer than that corresponding to the storage capacity of the conveyor belt (1). The terminal switch (33) is connected with the control of the drive roll on the yarn storage apparatus (stuffer box) and deactivates the transport of the yarn. When a sensor (41) mounted on the yarn treatment chamber (2) signals the exit of the last yarn loop (6), the conveyor belt (1) is deactivated. This prevents the yarn located in the yarn treatment chamber (2) and exposed to a definite treating atmosphere from being damaged by an excessive retention time in said atmosphere. The amount of waste (ruined) yarn may thus be reduced.

The system may operate in a manner other than described above. For instance, instead of waiting for the sensor (17) to determine that the motor (21) is no longer being controlled before the motor (25) is actuated, it would be possible to have the signal for actuating the motor (25) be supplied in response to the deactivation of the draw-off device (8). Upon reactivation of the draw-off device (8), the above-described procedure for reversing the movement of the motor (25) and returning control to the sensor (17) would be initiated.

Another alternative is depicted in FIG. 2, wherein the holding apparatus (11) may be selectively coupled directly with the conveyor belt (1) by means of a coupling element such as a clamp (36). Thus, in case of an interruption of the operation of the draw-off apparatus (8), the control device (19) does not actuate the control motor (25), but rather actuates the coupling element (36), which connects the trough (12) directly with the conveyor belt (1). This has the advantage that the trough (12) moves in exact synchronization with the conveyor belt (1) in the direction (A). The motor (25) permits such displacement of the holding device and slide.

However, during the return motion of the apparatus (11) into the operating position (X), the connection with the conveyor belt (1) must be released, and the conveyor chain (24) must become operational to displace the slide in the direction (D). But this return motion is not as difficult, because in the course of such motion the sensor (17) is already acting on the drive motor (21) of the draw-off apparatus (8) by means of the control device (19), thereby regulating the velocities. It would also be possible to drive the conveyor chain (24) opposite the direction (D) by means of the drive mechanism for the belt (1), and thereby eliminate the motor (25). In that case, a crossed drive chain would have to be provided for example between the drive roll (3) and the right-hand reversing roll (i.e., the roll to which the control motor (25) is shown connected). It would be necessary to switch between the forward and the return motions.

Figure 3:
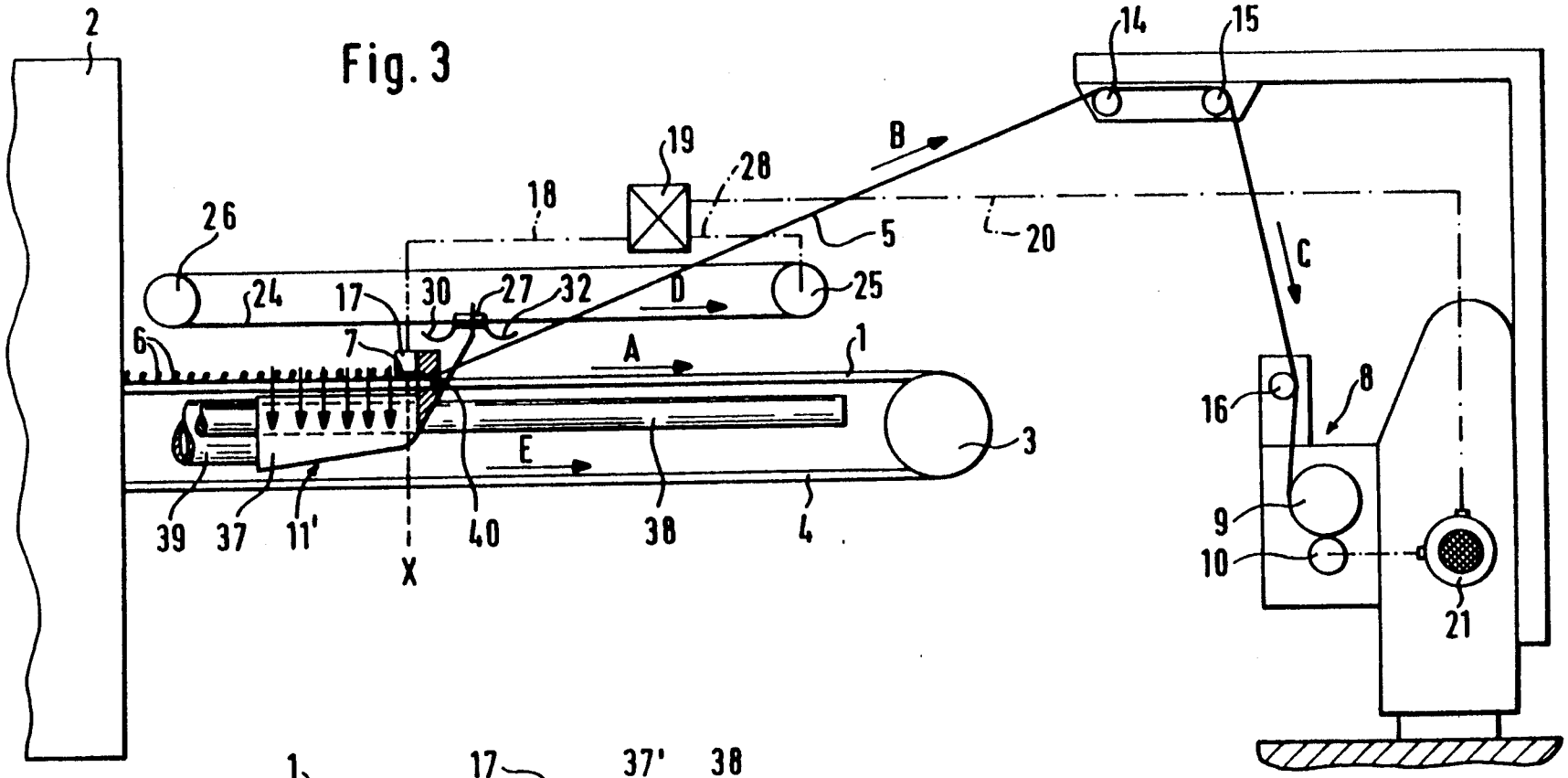
FIG. 3 is a view similar to FIG. 1, depicting another modification wherein the apparatus to keep the last loops flat comprises a suction box.

In a modification according to FIG. 3, the holding apparatus (11) comprises a suction box (37) located beneath the air-permeable conveyor belt (1) in a longitudinally displaceable manner on a guide rail (38). As the conveyor belt (1) is permeable, the suction flow, indicated in FIG. 3 by six adjacent arrows, acts on the yarn to hold the last loops (7) on the conveyor belt (1) and flatten them. In this manner, the yarn (5) is more easily drawn off the conveyor belt (1) in the area of the operating position (X), i.e., the last loops (7) are more readily untangled.

The suction box (37) carries at least one sensor (17), the carrier arm of which extends laterally across the conveyor belt (1). The suction box (37) further contains a thread looper (40), which performs the function of the reversing roll (13) in FIG. 1. Finally, the suction box (37) is connected by means of a holder (27) with the conveyor chain (24) already described relative to FIG. 1. The control and movement of the suction box (37) in and opposite the direction (E) takes place as described in connection with FIG. 1.

In the variant according to FIG. 3 it is not necessary to run the suction box (37) in exact synchronization with the conveyor belt (1), as the position of the draw-off point relative to the last loops (7) is not as critical The embodiment according to FIG. 3 further provides the advantage that the yarn (5) is cooled additionally by the flow of air suction, which is convenient prior to the draw-off, so that the yarn is not wound onto the spool (9) in an excessively warm condition.

The suction box (37) may contain at its side facing the conveyor belt a perforated metal plate communicating with a flexible suction line (39), which moves with the suction box (37) on the guide rail (38).

Figure 3A:
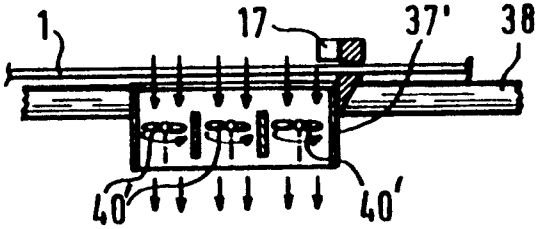
FIG. 3*a* is an enlarged side elevational view of a modified suction box.

Alternatively, it is possible, as shown in FIG. 3*a*, to connect the suction box (37') not to a central suction line, but to locate inside the suction box (37') several individually operating and controlled exhaust fans (40'). This expedient makes possible the sensitive adjustment of the suction forces to the yarn loops placed onto the permeable belt (1).

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. Apparatus for handling yarns, comprising:

conveying means for conveying looped yarn in a downstream direction, drawing-off means for drawing the yarn off said conveying means, sensing means for sensing the location of a terminal end of the looped yarn on said conveying means, control means operably connected to said drawing-off means and said sensing means for regulating the rate of drawing-off as a function of deviations in the location of the terminal end of the looped yarn, holding means disposed adjacent the terminal end of the looped yarn for holding the looped yarn against said conveying means prior to the looped yarn being drawn off, said holding means disposed in an operating position when said drawing off means is activated, displacing means for displacing said holding means in a downstream direction in response to said drawing-off means being deactivated and said conveying means remaining activated, whereby said holding means will be positioned in the vicinity of the terminal end of the looped yarn when said drawing-off means is reactivated, and for thereafter causing said holding means to be displaced upstream with the terminal end of the looped yarn as the yarn is drawn-off, and said sensing means being situated adjacent said holding means when said holding means is in said operating position.

2. Apparatus according to claim 1, wherein said sensing means is mounted for downstream and upstream displacement with said holding means and is operably connected to said displacing means for regulating a rate of upstream displacement of said holding means to maintain said holding means in the vicinity of the terminal end of the looped yarn.

3. Apparatus according to claim 1, wherein said holding means is located at a predetermined draw-off position prior to said downstream displacement thereof, said drawing-off means being operable to draw-off the looped yarn at a rate sufficiently high to return the terminal end of the looped yarn to said draw-off position following reactivation of said drawing-off means.

4. Apparatus according to claim 3 including switch means which is actuated when said holding means returns to said draw-off position to terminate upstream displacement of said holding means.

5. Apparatus according to claim 1, wherein said sensing means is mounted for downstream and upstream displacement with said holding means and is operably connected to said displacing means for regulating a rate of downstream displacement of said holding means.

6. Apparatus according to claim 1, wherein said displacing means includes a driven slide movable parallel to said conveying means, and means for connecting said holding means to said slide for movement therewith.

7. Apparatus according to claim 6 including a fixed guide rail on which said slide is slidable.

8. Apparatus according to claim 7, wherein said sensing means is mounted to said slide for movement with said side and said holding means.

9. Apparatus according to claim 8, wherein said slide is driven by a motor, said motor being connected to said sensing means to be controlled thereby for regulating a rate of travel of said holding means in the upstream direction upon reactivation of said drawing-off means.

10. Apparatus according to claim 1, wherein said displacing means includes connecting means for releasably connecting said holding means to said conveying means for movement therewith, said connecting means being releasable from said conveying means when said drawing-off means is reactivated, said displacing means including a motor-driven mechanism for displacing said holding means in the upstream direction when said drawing-off means is reactivated.

11. Apparatus according to claim 1, wherein said holding means comprises a convex surface facing said conveying means.

12. Apparatus according to claim 1, wherein said holding means comprises a suction box located beneath said conveying means, said conveying means being air permeable to enable suction air to act on the yarn.

13. Apparatus according to claim 12, wherein said suction box carries a plurality of exhaust fans.

14. Apparatus according to claim 1 including means which is activated when said holding means reaches a predetermined downstream position for terminating the insertion of looped yarn onto a yarn-receiving end of said conveying means.

15. Apparatus according to claim 14 including a yarn treating chamber disposed upstream of said holding means, and additional sensing means disposed at a downstream end of said yarn treating chamber and operably connected to said conveying means for deactivating said conveying means if an absence of looped yarn is detected.

16. A method of handling yarn comprising the steps of:

conveying looped yarn on a conveyor in a downstream direction, activating a drawing-off mechanism for drawing the yarn off the conveyor, providing a sensor for sensing the location of a terminal end of the looped yarn on the conveyor, delivering signals from said sensor to a control mechanism which regulates the rate of drawing-off as a function of deviations in the location of the terminal end of the looped yarn, providing a holding device adjacent the terminal end of the looped yarn for holding the looped yarn against the conveyor prior to the yarn being drawn off, deactivating the drawing-off mechanism while maintaining operation of the conveyor, whereby the terminal end of the looped yarn is conveyed downstream, displacing the holding device downstream to position the holding device in the vicinity of the terminal end of the looped yarn when the drawing-off mechanism is reactivated, reactivating the drawing-off mechanism, and thereafter, displacing the holding device upstream with the terminal end of the looped yarn as the yarn is drawn-off.

17. A method according to claim 16, wherein the sensor is displaced downstream and upstream with the holding device and regulates the rate of drawing-off during upstream displacement.

* * * * *